United States Patent [19]

Waldron et al.

[11] 4,072,394

[45] Feb. 7, 1978

[54] ELECTRICAL CONTACT ASSEMBLY

[75] Inventors: Clifford R. Waldron; Karl W. Yonkers; Robert Goebeler, all of Unadilla; David L. Frear, Binghamton; Edward J. Bright, Bainbridge, all of N.Y.

[73] Assignee: The Bendix Corporation, Southfield, Mich.

[21] Appl. No.: 662,678

[22] Filed: Mar. 1, 1976

[51] Int. Cl.[2] ..... H01R 11/08

[52] U.S. Cl. ..... 339/276 T

[58] Field of Search ..... 339/252, 256, 258, 259, 339/262, 275, 276; 174/84 C; 113/119

[56] References Cited

U.S. PATENT DOCUMENTS

| | | | |
|---|---|---|---|
| 2,689,337 | 9/1954 | Burtt et al. | 339/275 T |
| 2,804,602 | 8/1957 | Vizcarrondo | 339/256 R |
| 3,125,396 | 3/1964 | Bertram | 339/258 R |
| 3,137,925 | 6/1964 | Wahl | 339/276 R |
| 3,314,044 | 4/1967 | Powell | 339/276 R |
| 3,316,528 | 4/1967 | Jures et al. | 339/259 R |
| 3,317,887 | 5/1967 | Henschem et al. | 339/276 T |
| 3,648,224 | 3/1972 | McDonough | 339/276 T |
| 3,660,805 | 5/1972 | McDonough | 339/276 R |
| 3,721,943 | 3/1973 | Curr | 339/276 T |
| 3,920,310 | 11/1975 | Walsh et al. | 339/275 T |

FOREIGN PATENT DOCUMENTS

| | | | |
|---|---|---|---|
| 1,447,759 | 6/1966 | France | 339/258 R |
| 60,347 | 2/1968 | Germany | 339/276 T |

*Primary Examiner*—Joseph H. McGlynn
*Attorney, Agent, or Firm*—Raymond J. Eifler

[57] ABSTRACT

A three piece electrical contact assembly that includes an inner sleeve that is stamped and formed into a tubular shape from a flat sheet of metal. The electrical contact assembly provides a secure electrical and mechanical connection when crimped to a wire without the need for welding or brazing a seam (31) that results from forming the contact. The contact assembly includes: an inner sleeve having an enlarged middle portion (35) having forwardly and rearwardly facing shoulders for retention of the contact in a connector insert and a plurality of axially arranged slots (32) arranged in the wire receiving end of the contact assembly allow the contact assembly to distort symmetrically when a wire is crimped inside the contact; and a first and second outer sleeve (10,20) telescopically located over the front and rear portions, respectively, of the inner sleeve.

3 Claims, 15 Drawing Figures

FIG. 9
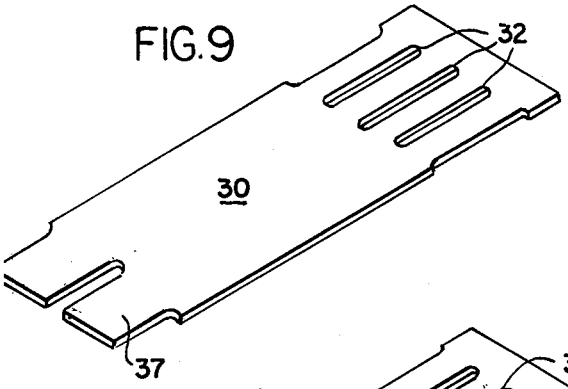
FIG. 10
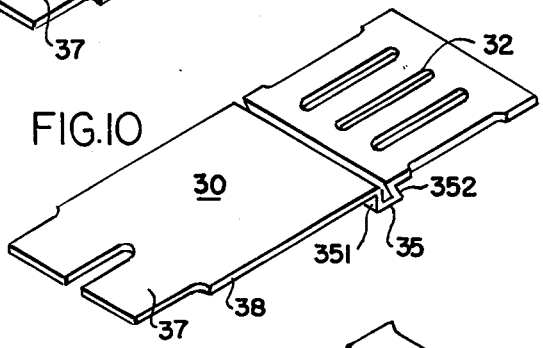
FIG. 11
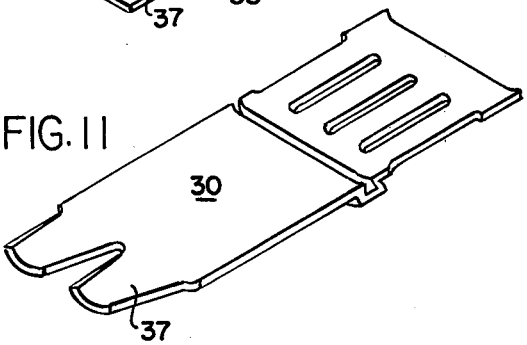
FIG. 12
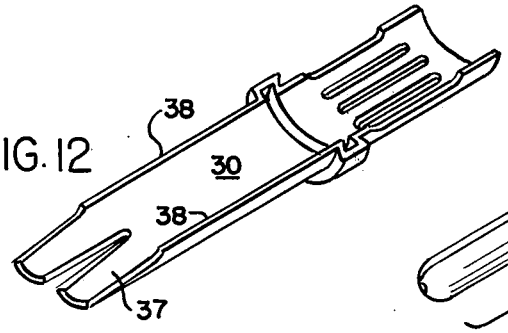
FIG. 13
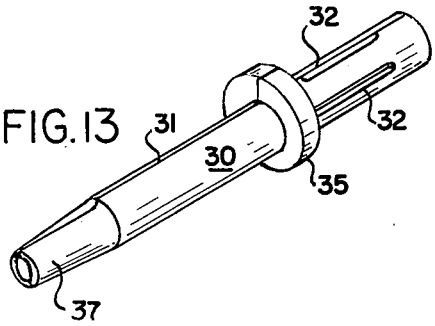
FIG. 14
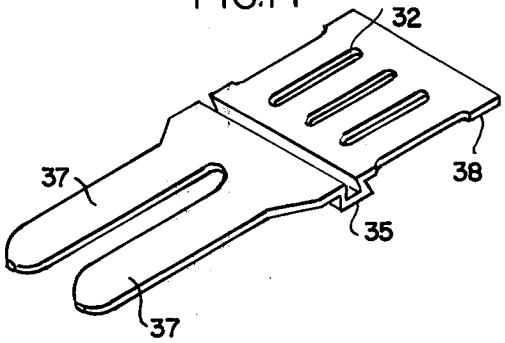
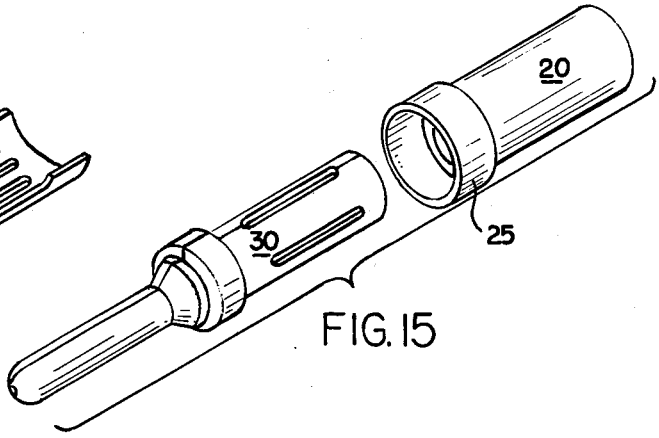
FIG. 15

ELECTRICAL CONTACT ASSEMBLY

CROSS-REFERENCE TO RELATED APPLICATION

This application is related to patent application Ser. No. 662,677 filed on Mar. 1, 1976 entitled "Electrical Contact Assembly," the inventors being Clifford R. Waldron, Karl W. Yonkers and Herbert k. Uhlig.

BACKGROUND OF THE INVENTION

This invention relates to electrical connectors of the type having a shell or housing; a plurality of contacts, each of which are connected to separate incoming wires; and a dielectric insert assembly for fixedly or removably mounting the electrical contacts in the connector shell. The invention is more particularly related to the electrical contact assembly and a method of making the electrical contact assembly.

Electrical connectors are utilized in electrical instrumentation to connect together the multiplicity of wires carrying electrical power and signals within and between different electrical instruments making up the system or systems. In the aerospace field, as electronic systems become more and more complex, they are miniaturized to minimize their weight and size. Hence, the electrical connectors interconnecting the systems must also be reduced in size. In some instances, electrical connectors which are no more than a few inches in diameter (called "miniature connectors"), carrying hundreds of electrical contacts which interconnect hundreds of wires. Each of the contacts and wires associated with such a connector are quite small (about one-half an inch lone with a diameter of about 0.092 inches). The wires which are terminated to these contacts generally have a diameter less than about 0.040 inches.

Generally, each of the contacts within the connector is removable so that it may be connected (by crimping) to an incoming wire when the electronic equipment is installed. Each of the incoming wires to the connector is attached to the contact by inserting the electrical wire into an axial opening in one end of the contact and then crimping the contact to the wire to obtain an electrical and mechanical connection. The crimping operation is performed by a well known plier type tool that, when squeezed, applies pressure simultaneously to two pairs of diametrically opposed points in the circumference of the contact to deform the contact wall into the wire within the contact. After the crimping operation, each of the contacts is inserted into the connector insert where they are retained by a contact retention mechanism.

Generally, electrical contacts are machined from metal stock and because of their small size, the contacts are machined to tolerances of 0.002 of an inch or less. A contact which is oversized for any reason cannot be utilized because it may not be possible to insert such a contact into the contact receiving holes in the connector insert or insufficient clearance between contacts could cause an electrical or mechanical problem. One example of an electrical connector having many removable contacts is shown in U.S. Pat. No. 3,721,943 entitled "Electrical Connecting Device" issued Mar. 20, 1973 to Maurice D. Curr.

Machining of electrical contacts is expensive and, because of the large number of contacts utilized by the connector, the connector is expensive. To reduce the cost of manufacturing a connector and at the same time provide an electrical contact that provides a secure electrical and mechanical connection when a wire was crimped to the contact, many inventors have turned to making an electrical contact by stamping and rolling (forming) the electrical contact from a sheet of metal. Examples of such contacts may be found in the following three U.S. patents hereby specifically incorporated by reference: U.S. Pat. No. 3,286,223 "Ferrule Construction and a Method for Producing Same" issued Nov. 15, 1966 to Ronald S. Narozny and Charles C. Anderson; U.S. Pat. No. 3,317,887 entitled "Contact Socket" issued May 2, 1967 to Homer E. Henschen and Marvin L. Yeager; and U.S. Pat. No. 3,721,943 entitled "Electrical Connecting Device" issued Mar. 20, 1973 to Maurice D. Curr.

In each of the foregoing patents, the inventors found it necessary to weld or braze the joint or seam that resulted when the contact was formed by rolling the flat stock. In the Curr patent, the abutting edges of the seam were brazed together. In the Narozny patent the edges that formed the seam were overlapped and spot welded together. As pointed out in the Curr patent, the seam is brazed so that the end portion of the contact is continuous around its circumference without any break therein. This approach enabled the end of the contact to be crimped to the end of a wire irrespective of the rotational position of the contact relative to the crimping tool. In most connectors used by the military and the aircraft industry, the wire is crimped to the contact at four points (about 90° apart). As pointed out in the Curr patent, when the free ends are not attached (not welded or brazed) to each other, the action of the edges of the open seam in the contact become displaced with respect to each other during the crimping operation so that a secure electrical and mechanical connection to the wire and contact does not occur. In addition to this, the crimping operation on a contact having an unbrazed or unwelded (open) seam can cause the end portion of the contact to distort unsymmetrically so that it becomes oversized and cannot be properly inserted into its position in the electrical connector.

Therefore, there have been many attempts to replace machined contacts with less expensive electrical contacts stamped and formed from a sheet of metal. In addition to this, inventors have been searching for practical alternatives to brazing or welding the seam that occurs in a contact formed from a stamping. The difficulty of welding or brazing the seam is emphasized when one considers that the sheet metal from which the contact is formed is only about 0.005 inches thick and the longitudinal seam is only a very small part of the contact diameter of about 0.048 inches (about the diameter of paper clip wire).

SUMMARY OF THE INVENTION

This invention is an electrical connector contact assembly that is stamped and formed into a tubular shape from a flat sheet of metal. The contact assembly provides a secure mechanical and electrical contact when a wire is crimped to the electrical contact without the need to braze or weld the seam resulting from forming the cylindrical contacts from flat stock.

The invention is an electrical connector contact assembly that is stamped and formed from a piece of sheet metal and is characterized by the fact that the tubular inner sleeve, formed from the sheet metal, does not have any brazed or welded seams but rather, includes a plurality of elongated slots 32 in the wire receiving portion of the sleeve and an enlarged middle portion having forwardly and rearwardly facing shoulders 351, 352 for retaining the contact within a connector insert. In one specific embodiment of the invention, the electrical contact is made of three pieces: an inner sleeve 30; a first outer sleeve 20; and a second outer sleeve 10; the inner sleeve 30 has an open (unwelded) seam 31, four axial slots 32 in the wire receiving portion that are spaced 90° apart around the circumference of the inner sleeve 30, and an enlarged middle portion 35. The enlarged middle portion 35 includes a rearwardly facing shoulder 352 and a forwardly facing shoulder 351 that provides for locating the outer sleeve 10 and contact retention within a connector insert.

Accordingly, it is an object of this invention to provide a three piece contact assembly that is simple in construction and economical to manufacture.

It is also an object of this invention to replace expensive machined electrical contacts with inexpensive electrical contacts that are stamped and formed from a sheet of metal.

It is also an object of this invention to provide an electrical contact stamped and formed from a sheet of metal which, when crimped to a wire, will provide a secure mechanical and good electrical connection to the wire.

It is still another object of this invention to provide an electrical contact that can be fabricated relatively easy in large quantities at a low cost.

It is still a further object of this invention to provide an inexpensive electrical connector that contains electrical contacts that are stamped and formed from a single sheet of metal.

The above and other objects and features of the invention will become apparent from the following detailed description taken in conjunction with the accompanying drawings and claims which form a part of this specification.

BRIEF DESCRIPTION OF THE DRAWINGS

FIGS. 9 through 13 illustrate the process by which a socket type contact is formed from a sheet of flat metal.

FIGS. 14 and 15 illustrate the process by which a pin type contact is formed from a sheet of flat metal.

DETAILED DESCRIPTION OF THE DRAWINGS ILLUSTRATING THE INVENTION

Figure 1:
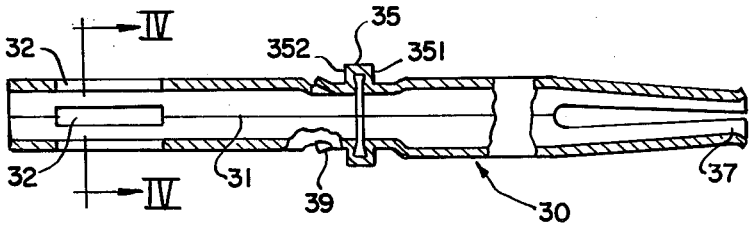
FIGS. 1, 2 and 3 are views illustrating the three pieces that comprise an electrical socket type contact assembly incorporating the principles of this invention.
Figure 2:
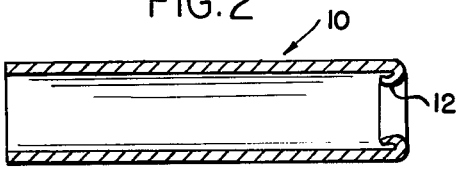
Figure 3:
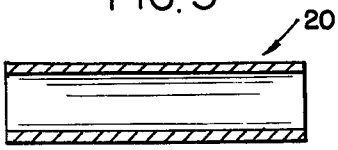

FIGS. 1, 2 and 3 illustrate the three components that make up an electrical socket contact assembly for an electrical connector.

FIG. 1 illustrates the inner sleeve 30 of a contact assembly which is stamped and formed from a sheet of beryllium copper material having a wall thickness of about 0.005 inches. In some instances, the sleeve 30 has a gold plating thereon to provide good electrical current carrying characteristics. In one type of contact assembly the inner sleeve 30 has a diameter of about 0.048 inches and is about 0.491 inches long. The inner sleeve 30, when initially stamped and formed, includes an axial seam 31 that extends its entire length. The seam 31 is referred to as an "open seam" because the abutting edges that form the seam are not mechanically bonded together by brazing or welding. The edges of the open seam 31, since they are not bonded, can be separated by the application of a mechanical force such as that applied by a crimping tool. The inner sleeve 30 further includes a forward portion having a plurality of spring fingers 37 which are resiliently deflectable in a radial direction. The forward portion of the inner sleeve 30 with the spring fingers 37 forms the front portion of the socket contact for receiving a male pin type electrical contact. The inner sleeve 30 also includes an enlarged middle portion 35 that has a forwardly facing shoulder 351 and a rearwardly facing shoulder 352 that are required for retaining the contact assembly in the insert of a connector. Radially extending fingers or projections 39 may be formed in the inner sleeve for locating the rear sleeve 20 not shown over the rear portion of the inner sleeve 30.

FIG. 2 illustrates a first outer sleeve 10 which is fabricated by drawing a piece of metal (e.g. stainless steel) through a die to obtain a sleeve having a diameter of about 0.062 inches to 0.078 inches with a wall thickness of about 0.004 inches. The front portion of the sleeve is formed to provide a tapered entry 12 for guiding a male pin type electrical contact into the bore of the sleeve 10.

FIG. 3 illustrates an intermediate sleeve 20 that is formed by drawing a piece of metal (e.g. stainless steel) through a die to obtain a sleeve having a diameter of about 0.058 inches with a wall thickness of about 0.005 inches. The intermediate sleeve 20 is generally fabricated from a stainless steel to provide the necessary mechanical strength to the complete contact assembly.

Figure 4:
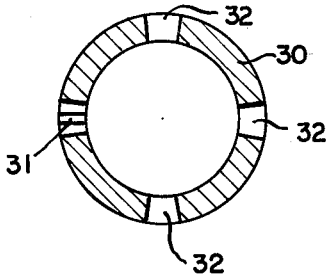
FIG. 4 is a cross-sectional view of the inner sleeve of the contact assembly taken along lines IV—IV of FIG. 1.

FIG. 4 illustrates a cross-sectional view of the inner sleeve 30 taken along lines IV—IV of FIG. 1. In the preferred embodiment of the invention wherein the contact assembly is utilized in a connector, and crimped in four places, the inventors believe that it is preferred to have four slots 32 arranged symmetrically (90° apart) around the circumference of the inner sleeve 30. Further, the inventors suggest that one of the slots 32 should intercept the open seam 31 in the inner sleeve 30. The inventors have observed from microphotographs that inner sleeves 30 having such an arrangement of slots 32 provide a symmetrically crimped wire contact shown in FIG. 2.

Figure 5:
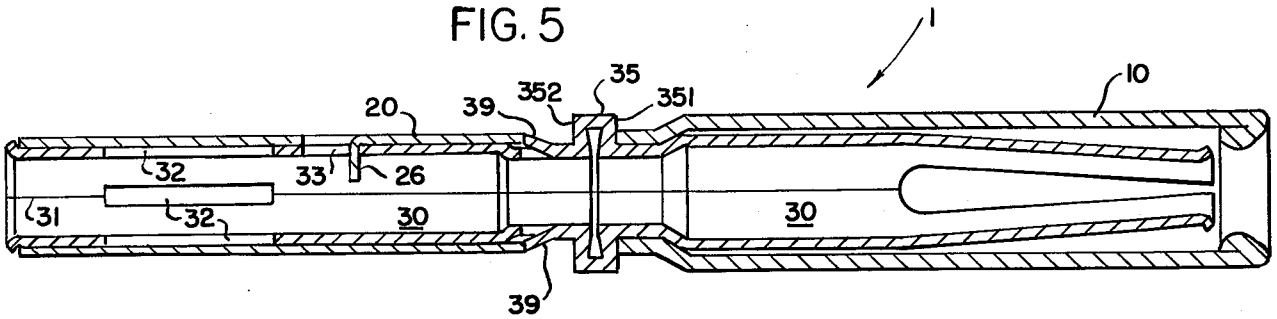
FIG. 5 illustrates a cross-sectional view of a preferred embodiment of an electrical contact assembly incorporating the principles of the invention.

FIG. 5 illustrates a cross-sectional view of an electrical contact assembly 1 incorporating the principles of this invention. FIG. 5 illustrates the contact assembly 1 before a wire is inserted into the contact assembly and crimped thereto. FIG. 5 illustrates the location of the first or forward outer sleeve 10 over the forward portion of the inner sleeve 30 and the location of the second or rear outer sleeve 20 over the rear portion of the inner sleeve 30. In this embodiment, the second outer sleeve 20 includes a radially inwardly extending fingers 26 that extends through an aperture 33 in the inner sleeve. It is the function of this inwardly extending finger 26 to provide an internal wire stop means within the bore of the inner sleeve 30. Alternately, the wire stop means could be provided by punching radially inwardly extending fingers from both the inner sleeve 30 and the rear sleeve 20. Such an operation would automatically result in the formation of the inspection hole 33. The enlarged portion 35 of the inner sleeve 30 provides forwardly 351 and rearwardly 352 facing shoulders that aid in the location of the forward sleeve 10 on the inner sleeve as well as providing the means for retaining the contact assembly 1 within an electrical connector assembly. In this embodiment the rearwardly facing shoulder 352 is not used to locate the rear sleeve 20 although such use could be made of such shoulder. Instead, at least one (preferably two) radial fingers 39 are employed to locate the rear sleeve 20 over the rear portion of the inner sleeve 30. This approach leaves more cross-sectional area of the rearwardly facing shoulder 352 exposed and available for retaining the contact within a connector assembly. Thus, the rearwardly facing shoulder provides improved contact retention and release capabilities.

Figure 6:
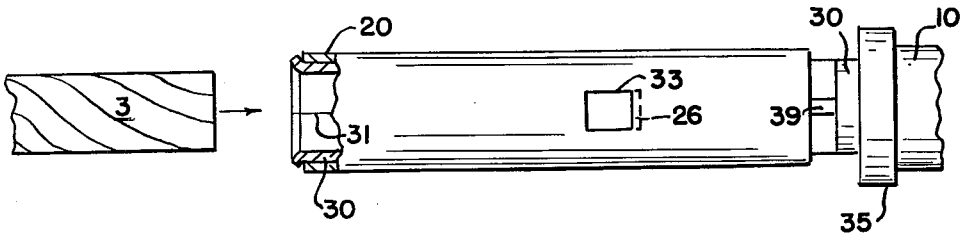
FIGS. 6 and 7 illustrate how a wire is inserted and crimped to the contact assembly.

FIG. 6 illustrates a partial diagrammatic view of a portion of the contact assembly before a wire 3 is inserted into the rear wire receiving end of the contact assembly and crimped thereto.

Figure 7:
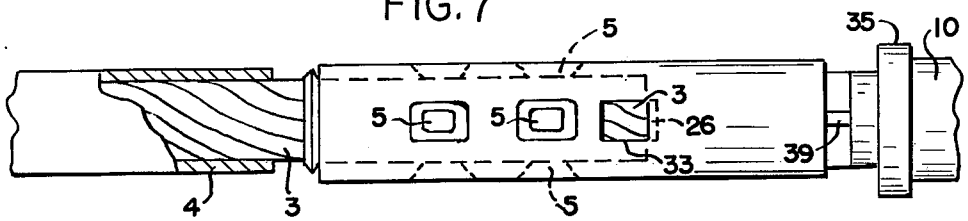

FIG. 7 illustrates a partial diagrammatic view of a portion of the contact assembly with a wire 3 inserted in the rear wire receiving end of the contact assembly and crimped thereto. The insulation 4 around an electrical wire 3 has been removed from a portion of the electrical wire 3 and the bare portion of the electrical wire has been inserted into the rear portion of the contact assembly until it abuts against the inwardly extending finger 26. The inspection hole 33 permits visual verification that the wire 3 has extended beyond the crimping points 5 in the rear of the contact assembly. The crimping points 5 distort the outer and inner sleeve 20 inwardly so that the inner sleeve 30 is crushed into the wire 3 to form a good electrical and mechanical connection.

Figure 8:
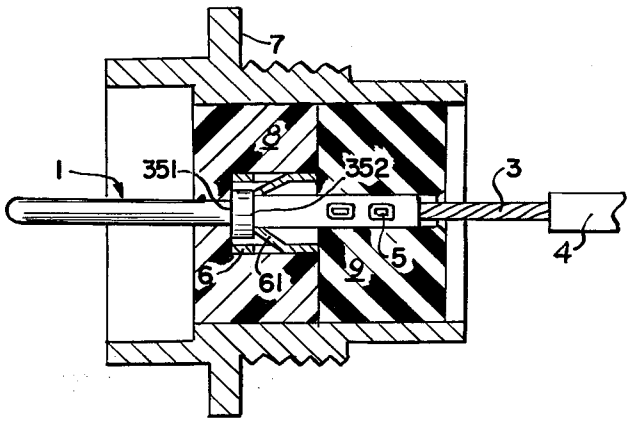
FIG. 8 illustrates a diagrammatic cross-sectional view of an electrical connector assembly incorporating the novel contact assembly.

FIG. 8 is a diagrammatic illustration of an electrical connector assembly of the type having several electrical pin type or socket type contacts mounted therein. For the purposes of clarity, only one such type contact is shown. An electrical connector assembly generally includes a cylindrical metal shell 7 that has mounted therein a dielectric insert. In this illustration the dielectric insert is composed of two pieces 8 and 9. The forward piece 8 includes a contact retention mechanism 6. The contact retention mechanism 6 includes a plurality of deflectable spring fingers 61 that engage the rearwardly facing shoulder 352 of the contact assembly while a rearwardly facing shoulder in the forward insert 8 contacts the forwardly facing shoulder 351 of the contact assembly thereby maintaining the electrical contact assembly 1 in a fixed position within the insert 8.

STAMPING AND FORMING OF THE ELECTRICAL CONTACT

FIGS. 9 through 13 illustrate the steps associated with stamping and forming the inner sleeve of a cylindrical socket contact assembly.

FIG. 9 illustrates the original configuration of the inner sleeve 30 of a socket contact assembly when the sleeve 30 is stamped out of a sheet of flat metal. The stamping may be accomplished in one step wherein the overall shape of the contact is stamped out as well as stamping out the slots 32 and the forward fingers 37 which will be formed into a socket that receives a pin type electrical contact. Also, the stamping may include at least one finger extending outwardly and in the direction of the slots (see 39, FIG. 5).

FIG. 10 includes the next step in the process wherein a raised portion 35 having forwardly and rearwardly facing shoulders (351, 352) are formed into the stamped piece 30.

FIG. 11 illustrates the next step in the process wherein the longitudinal edges 38 and the fingers 37 are partially rolled.

FIG. 12 illustrates the next step in the process wherein the inner sleeve 30 is rolled to a greater extent than the previous step.

FIG. 13 illustrates the final configuration of the inner sleeve 30 after the sleeve has been completely formed to obtain a cylindrical sleeve 30 that has a longitudinal seam 31, spring fingers 37 that receive a pin type electrical contact, and an enlarged portion 35.

FIGS. 14 and 15 illustrate how a pin type electrical contact is formed from a stamping.

FIG. 14 shows the configuration of the pin type electrical contact after it has been stamped and partially formed from a sheet of flat metal. The stamping includes a plurality of apertures 32, forwardly projecting fingers 37, and an enlarged portion 35.

FIG. 15 illustrates the stamping completely formed into a pin type electrical contact 30. The forwardly projecting portions 37 in this instance have been rolled together and formed into a cylindrical pin type electrical contact. The stamped and rolled pin type electrical contact also includes seam 31 formed by abutting edges 38. Telescopically located over the rear portion of the inner sleeve 30 is an outer sleeve 20 which, together with the inner sleeve 30, form the pin type electrical contact assembly. The outer sleeve 20 includes a raised portion 25.

While a preferred embodiment of the invention has been disclosed, it will be apparent to those skilled in the art that changes may be made to the invention as set forth in the appended claims, and, in some instances, certain features of the invention may be used to advantage without corresponding use of other features. For example, the drawings illustrate socket contact assemblies although they could just as well be pin type contact assemblies. Further, although only four axial slots 32 are shown in the rear portion of the contact assembly to provide the necessary stress relief during the crimping operation to prevent unsymmetrical distortion of the contact assembly, additional slots may be provided. Further, the stress relief may be provided by 10 or 20 apertures arranged in the rear wire receiving portion of the inner sleeve 30. The only limit on the number of apertures in the rear wire receiving portion is dictated by the electrical conductivity requirements (minimum voltage drop) between the inner sleeve 30 and the wire 3 when the inner sleeve is crimped to the wire. Certainly, too many apertures would eliminate much of the conducting material necessary to make good electrical contact.

Accordingly, it is intended that the illustrative and descriptive materials herein be used to illustrate the principles of the invention and not to limit the scope therof.

We claim:

1. An electrical connector assembly comprising:

a housing;

a dielectric insert mounted within said housing, said insert having a plurality of axial bores therein;

means for mounting an electrical contact in each of said axial bore; and a plurality of electrical contact assemblies each mounted in a respective bore by said contact mounting means, said electrical contact assemblies comprising:

a sleeve stamped and formed from a sheet of metal, said sleeve having:

a front pin portion for mating with a socket contact; and a rear wire receiving portion having an unwelded seam, and a plurality of axially extending slots in the wall of said sleeve equally spaced from each other with the longitudinal axis of each of said slots parallel to the longitudinal axis of said sleeve;

an enlarged portion located between said front portion and said rear portion, said enlarged portion including a forwardly facing shoulder and a rearwardly facing shoulder; and an outer sleeve located over the rear wire receiving portion of said sleeve.

2. A method of fabricating a pin type electrical connector contact assembly comprising the steps of:

stamping from a sheet of metal, a flat piece having a plurality of slots in a rear portion, a plurality of fingers extending from an opposite front portion, said slots equally spaced from each other with the longitudinal axis of each of said slots parallel to the longitudinal axis of one of said fingers;

forming an enlarged portion located between said front portion and said rear portion, said enlarged portion including a forwardly facing shoulder and a rearwardly facing shoulder;

forming said flat piece into a tubular form having axially extending slots, an axially extending seam and a front pin shaped portion;

placing a first sleeve over the rear portion of said tubular form having the slots therein; and attaching said outer sleeve to said tubular form.

3. A method of fabricating a pin type electrical connector contact assembly as recited in claim 2 including the steps of:

inserting an electrical conductor into the rear portion of the tubular form having the slots therein; and applying force to said outer sleeve to crimp part of the rear portion of the tubular form having the slots therein into the electrical conductor to form an electrical and mechanical connection between the electrical conductor and said tubular form.

* * * * *